United States Patent [19]

Roberts et al.

[11] Patent Number: 4,932,176

[45] Date of Patent: Jun. 12, 1990

[54] EXTENDIBLE AND RETRACTIBLE MAST SYSTEM

[75] Inventors: John E. Roberts, Los Altos; Jerome L. Hitchcock, Mountain View, both of Calif.

[73] Assignee: GTE Government Systems Corporation, Stamford, Conn.

[21] Appl. No.: 246,112

[22] Filed: Sep. 19, 1988

[51] Int. Cl.[5] ..... B66C 23/06; H01Q 1/28

[52] U.S. Cl. ..... 52/118; 52/121; 182/625; 182/148; 212/264; 212/267; 343/883; 343/902; 343/DIG. 2; 414/282; 414/662

[58] Field of Search ..... 52/110, 111, 118, 117, 52/121; 182/62.5, 63, 141, 148, 127; 212/264, 267, 269; 414/282, 662, 663; 343/883, 901, 902, DIG. 2

[56] References Cited

U.S. PATENT DOCUMENTS

| | | | |
|---|---|---|---|
| 3,359,559 | 12/1967 | Guinn | 52/110 X |
| 3,495,364 | 2/1970 | De Bella | 52/118 |
| 4,137,535 | 1/1979 | Rupprecht | 343/902 |
| 4,309,854 | 1/1982 | Vendramini | 52/118 X |
| 4,388,033 | 6/1983 | Pipes | 414/282 |
| 4,587,526 | 5/1986 | Ahl, Jr. | 52/110 X |

FOREIGN PATENT DOCUMENTS

| | | | |
|---|---|---|---|
| 771311 | 10/1980 | U.S.S.R. | 52/118 |

*Primary Examiner*—Richard E. Chilcot, Jr.

*Attorney, Agent, or Firm*—Douglas M. Gilbert; John E. Lawler

[57] ABSTRACT

A telescopic mast system has a base tube, a plurality of axially movable coaxial inner tubes nestable successively within each other and within the base tube, and a winch supported at the lower end of the base tube with a pair of preferably wire ropes driven thereby for extending and retracting the inner tubes. The base and inner tubes have collars at their respective ends, the collars of adjacent tubes engaging each other to limit extension thereof and to provide additional structural support during application of bending loads on the mast system. The ropes are connected to pulleys mounted near or within tube collars so that the ropes and pulleys are totally enclosed within the mast system. As the winch is rotated in one direction, the ropes axially move the inner tubes from a nested or stowed position within the base tube to a fully vertically extended operational position. When the winch is rotated in the opposite direction, the ropes apply a positive retractive force to the inner tubes and return them to the fully nested stowed position.

13 Claims, 13 Drawing Sheets

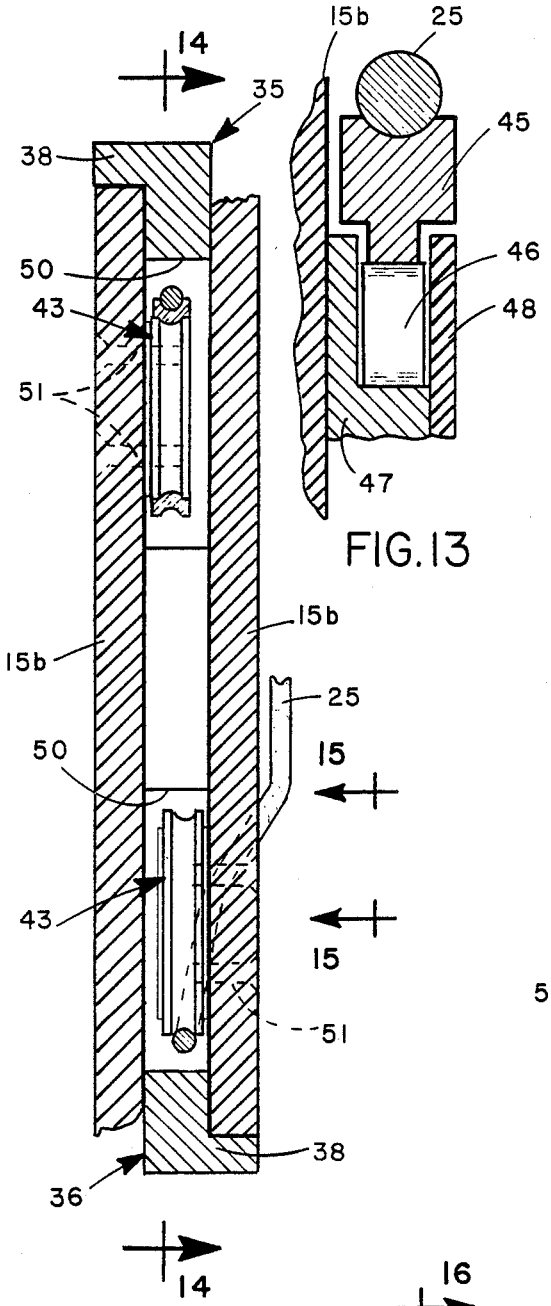
FIG. 12
FIG. 13
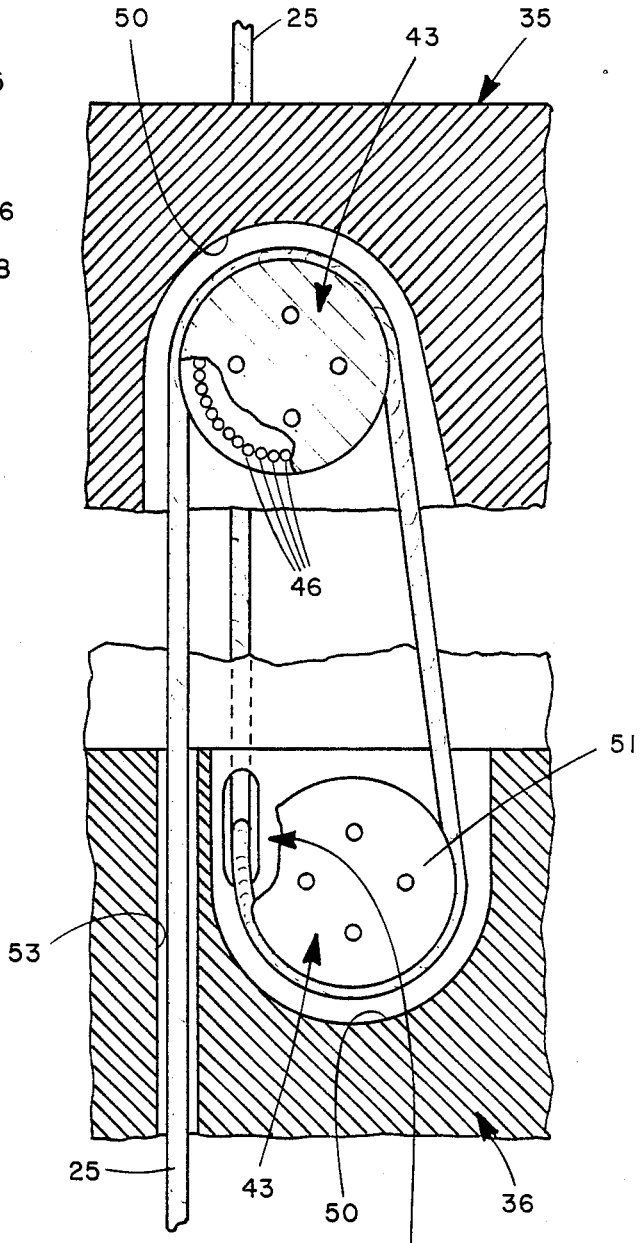
FIG. 14
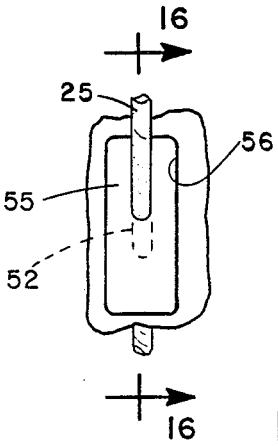
FIG. 15
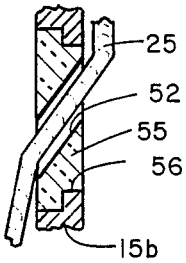
FIG. 16
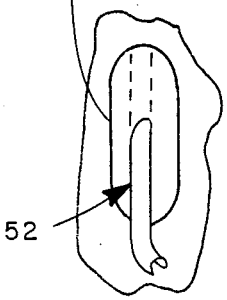

EXTENDIBLE AND RETRACTIBLE MAST SYSTEM

BACKGROUND OF THE INVENTION

1. Field of the Invention

The present invention relates to extendible and retractible mast systems, and more particularly to such a system utilizing a plurality of telescoping nestable tubes useful for supporting payloads such as antennas, electronic sensors/transmitters, cameras and the like.

2. Description of the Prior Art

The use of communications and various electronic and optical equipment in hostile military environments often requires erecting antennas and the like as high as 20 meters or more above ground in order to facilitate the transmission and reception of signals to and from distant locations. With portable tactical military systems, it is often essential that such an antenna be elevated from and quickly retracted to a stowed position on a transporting vehicle with a minimum of personnel and in all types of hostile environments. These requirements are particularly difficult during winter months. At below freezing temperatures, ice formations tend to lock the extended mast sections together and to block or resist retraction of the mast to a stowed/nested position. Ice accretion not only impedes retraction and disassembly but also tends to unduly load and possibly damage any exposed elements or parts of the mast retracting mechanism. In addition to ice accumulation winter winds increase the cantilevered forces exerted on an extended loaded mast. Furthermore, exposure of the elevating and retracting mechanism to harsh weather conditions causes corrosion and deterioration of exposed parts so as to hamper their operation and require frequent repair or replacement thereof.

Early portable mast systems consisted of a plurality of separate identical mast sections mechanically coupled together and raised into and secured usually in a vertical operating position with guy wires. This required the handling of many separate parts and also required considerable time to erect and dismantle the mast. Consequently for dynamic tactical military conditions, such systems were useless or nearly so. Other more sophisticated prior mast systems employed nested tubes that were extended and retracted by pneumatic or hydraulic means. Not only were these systems complex and very expensive, but they were especially vulnerable to disablement by bullets or shrapnel in hostile military environments. A single projectile penetrating an extended mast could easily have caused decompression of the pneumatic or hydraulic chamber or alternatively caused the mast to be locked in an extended position through deformation of the metallic tube(s).

Other drawbacks of pneumatic masts are they are very heavy which adversely affects portability, especially in the field., they have no positive means of retraction., large space is required to store the air tanks; and loss of power results in immediate retraction due to decompression.

Present use of extruded cylindrical aluminum tubes has several disadvantages: it is very difficult to extrude tubes having diameters in excess of 11 inches, thereby limiting the use of larger tubes., tolerances are difficult to hold tightly, resulting in costly rejects and fit-match procedures; circular tubes require keys and keyways to prevent rotation between tubes, and aluminum keys are readily subject to wear which results in excessive play between tubes.

This invention is directed to a mast system which overcomes these shortcomings and disadvantages.

OBJECTS AND SUMMARY OF THE INVENTION

A general object of the invention is the provision of an extendible and retractible mast system in which the operating mechanism is totally enclosed and thus is protected from the elements. Another object of the invention is the provision of a mast system that can be quickly moved from the stowed to operative vertical or horizontal positions with a minimum of personnel.

A further object is the provision of such a system with positive retractive forces for returning the system from the position of full extension to full retraction.

Still another object is the provision of such a system that is light in weight and thus readily portable and deployable in the field on a trailer or other vehicle.

Still another object is the provision of a rugged mast system that can be treated with abuse which commonly occurs in the field without serious damage to the mast.

These and other objects of the invention are achieved with a mast system having a plurality of telescoping tubes with overlapping end sections having physical stops for limiting movement of the tubes beyond full extension. The collars also house pulleys or provide space for pulleys which are for use in extending and retracting the tubes. Ropes wound on capstans as parts of a winch at the base of the tube assembly successively engage the pulleys from the outermost to the innermost tubes and apply forces to the tubes for positive retraction or extension thereof depending on the direction of rotation of the capstans.

BRIEF DESCRIPTION OF THE DRAWINGS

For a better understanding of the invention as well as other objects and further features thereof, reference is made to the following drawings wherein:

FIG. 12 is an enlarged vertical section of parts of two adjacent mast tubes showing the associated collars, pulleys and rope.

FIG. 13 is a greatly enlarged vertical section of the peripheral portion of a pulley showing details of construction.

FIG. 14 is a vertical section taken on line 14—14 of FIG. 12.

FIG. 15 is an interior view of part of a tube wall taken on line 15—15 of FIG. 12.

FIG. 16 is a section taken on line 16—16 of FIG. 15.

DESCRIPTION OF PREFERRED EMBODIMENT

Figure 1:
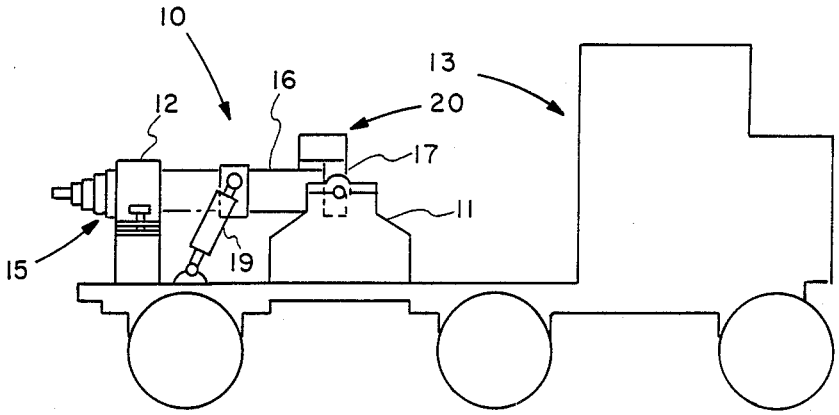
FIGS. 1 and 2 are schematic drawings showing a vehicle-mounted mast system embodying this invention in the stowed and operational positions, respectively.

Referring now to the drawings, FIG. 1 depicts a mast system 10 embodying this invention in a retracted or stowed horizontal position supported on a pillow block 11 and secured by a saddle-clamp device 12 to a vehicle 13. Vehicle 13 is shown only to illustrate the compact and mobile nature of the mast system embodying this invention. However, inasmuch asmuch as the vehicle and its motorized elements are not deemed to be constituent elements of the invention, further description of the vehicle is not given here.

Figure 2:
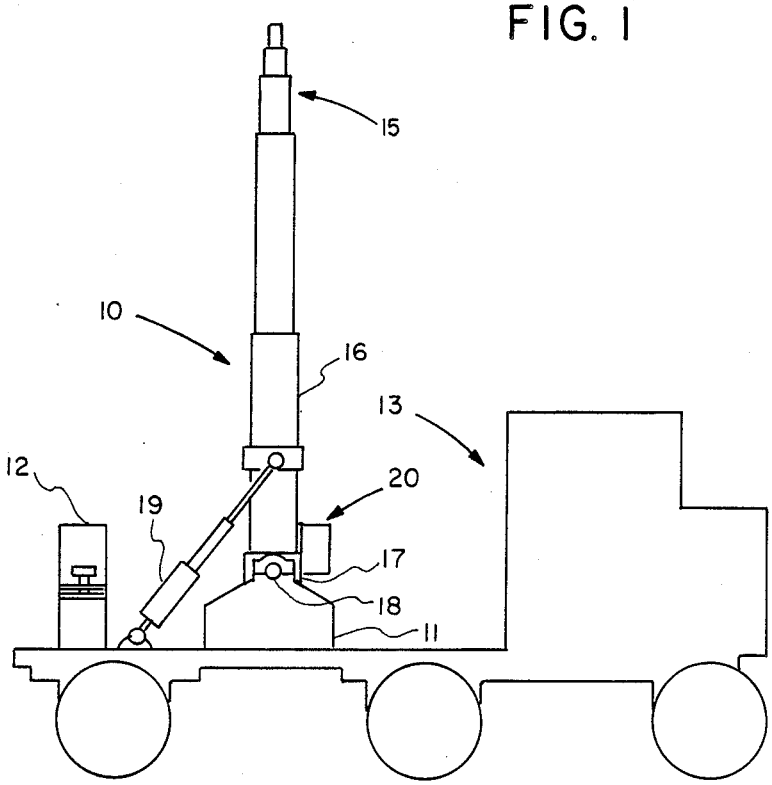

Mast system 10 comprises a plurality of axially movable telescoping inner tubes 15 having successively decreasing transverse dimensions and an axially fixed outer base tube 16 which houses tubes 15 in the stowed (nested) position and supports them in an extended position. Base tube 16 attaches to a support base 17 which in this embodiment has a horizontal trunnion 18 for supporting mast system 10 on pillow block 11 for rotation about the trunnion axis by hydraulic motor 19 between the horizontal stowed position shown in FIG. 1 and an upright operating position shown in FIG. 2. Each of the tubes has a uniform shape and a constant transverse dimension as depicted in several of the drawings.

Figure 4:
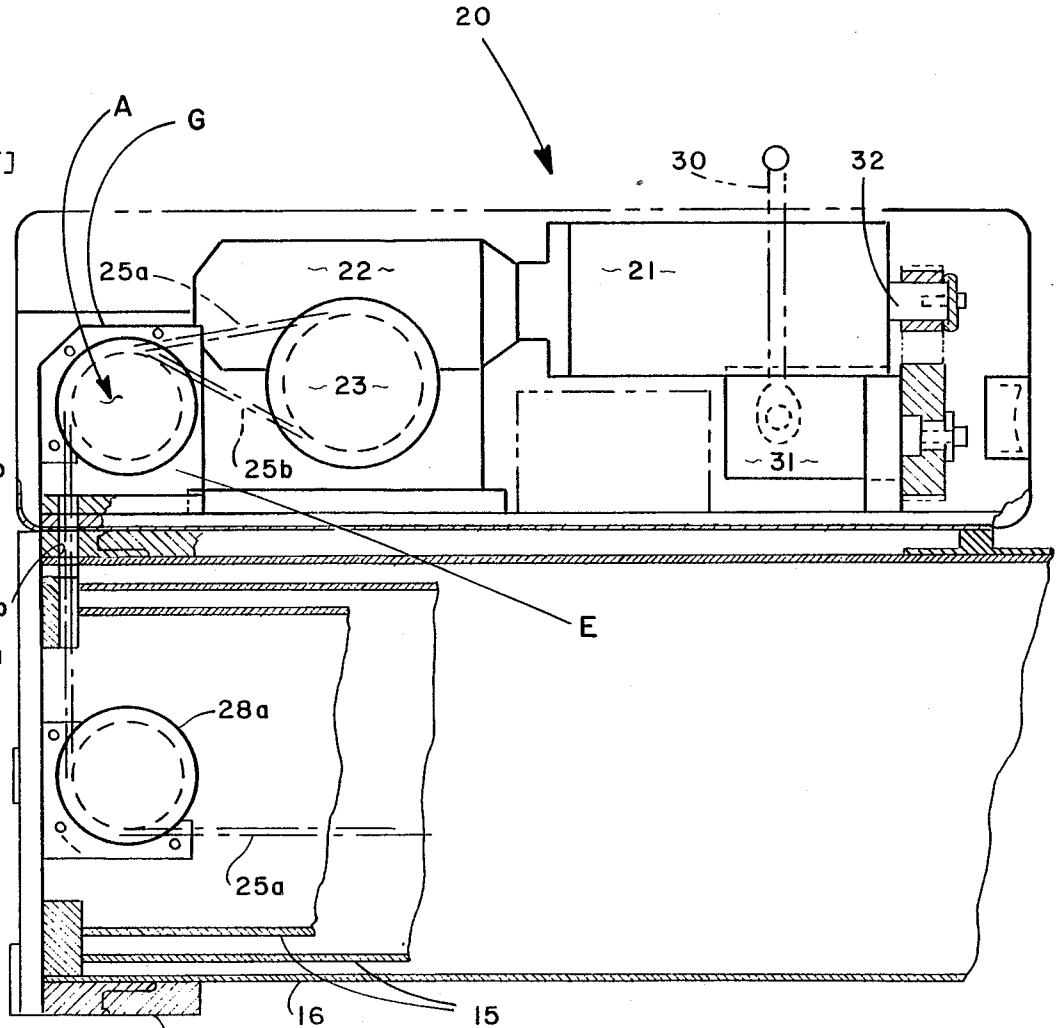
FIG. 4 is an elevation partly in section of the winch and part of the lower tube taken on line 4—4 of FIG. 3.
Figure 3:
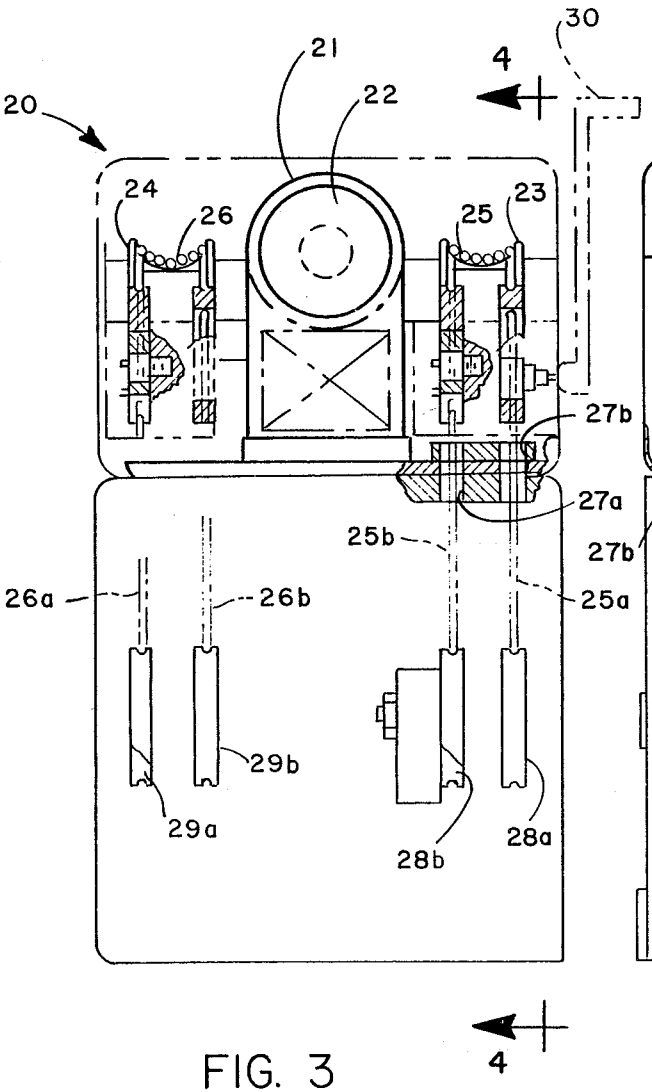
FIG. 3 is a bottom view partly in section of the winch and tube assembly.
Figure 4A:
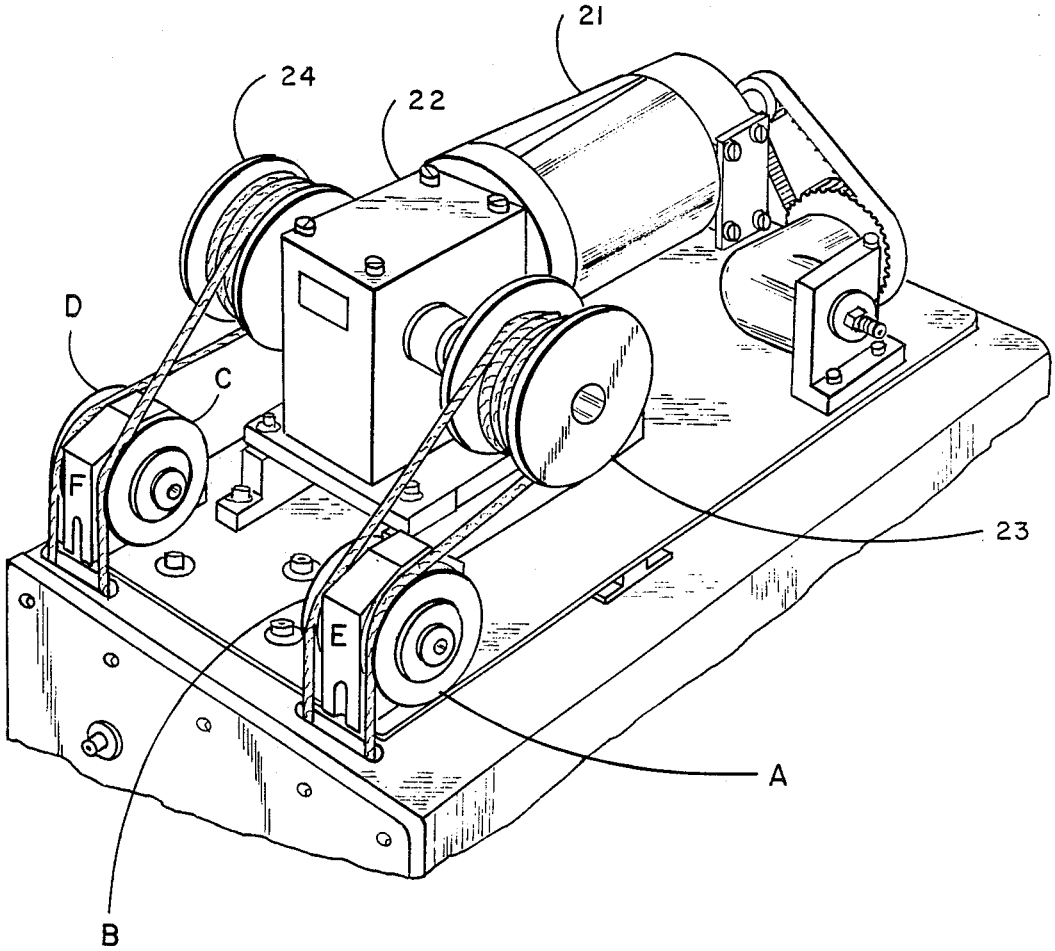
FIG. 4*a* is a perspective view of the winch and motor assembly.

In the preferred embodiment of the invention, tubes 15 are extended and retracted by a winch 20, see FIGS. 3, 4 and 4*a*, mounted on base tube 16 and comprising an electric motor 21 connected to a speed reducer 22 which drives two capstans 23 and 24 on which preferably wire ropes 25 and 26, respectively, are wound. Capstans 23 and 24 have two rope lengths 25 (a and b), and 26 (a and b), respectively. The ropes extend from opposite ends to of capstans 23 and 24, to pulleys 28 (a and b) and 29 (a and b), respectively, which are mounted on pulley blocks E and F and are held in place with retainers G and H around an approximate 90° angle. Only block E and retainer G are shown in FIG. 4. The ropes extend through laterally spaced openings in tube 16, one set 27*a*, 27*b* of such openings being shown in the drawings. Rope lengths 25*a* and 26*a* pass around base supported pulleys 28*a* and 29*a*, respectively, for routing through to an assemblage of tube lift and retraction pulleys and connection to terminations on the innermost tube 15*a* described in detail below. A hand crank 30 connected by a mechanical drive 31 to the shaft 32 of winch motor 21 is an alternate to the electric motor and permits manual operation of the winch, if desired. Capstans 23 and 24 are rotated as a pair in either a clockwise or a counter-clockwise direction by motor 21 or crank 30 for extending and retracting tubes 15. As shown and described below in connection with FIG. 19 it is possible to fully operate the mast system with only a single rope 25 and capstan 23, as opposed to the redundant dual rope/capstan embodiment shown in FIGS. 3, 4, 10 and 11.

Figure 20:
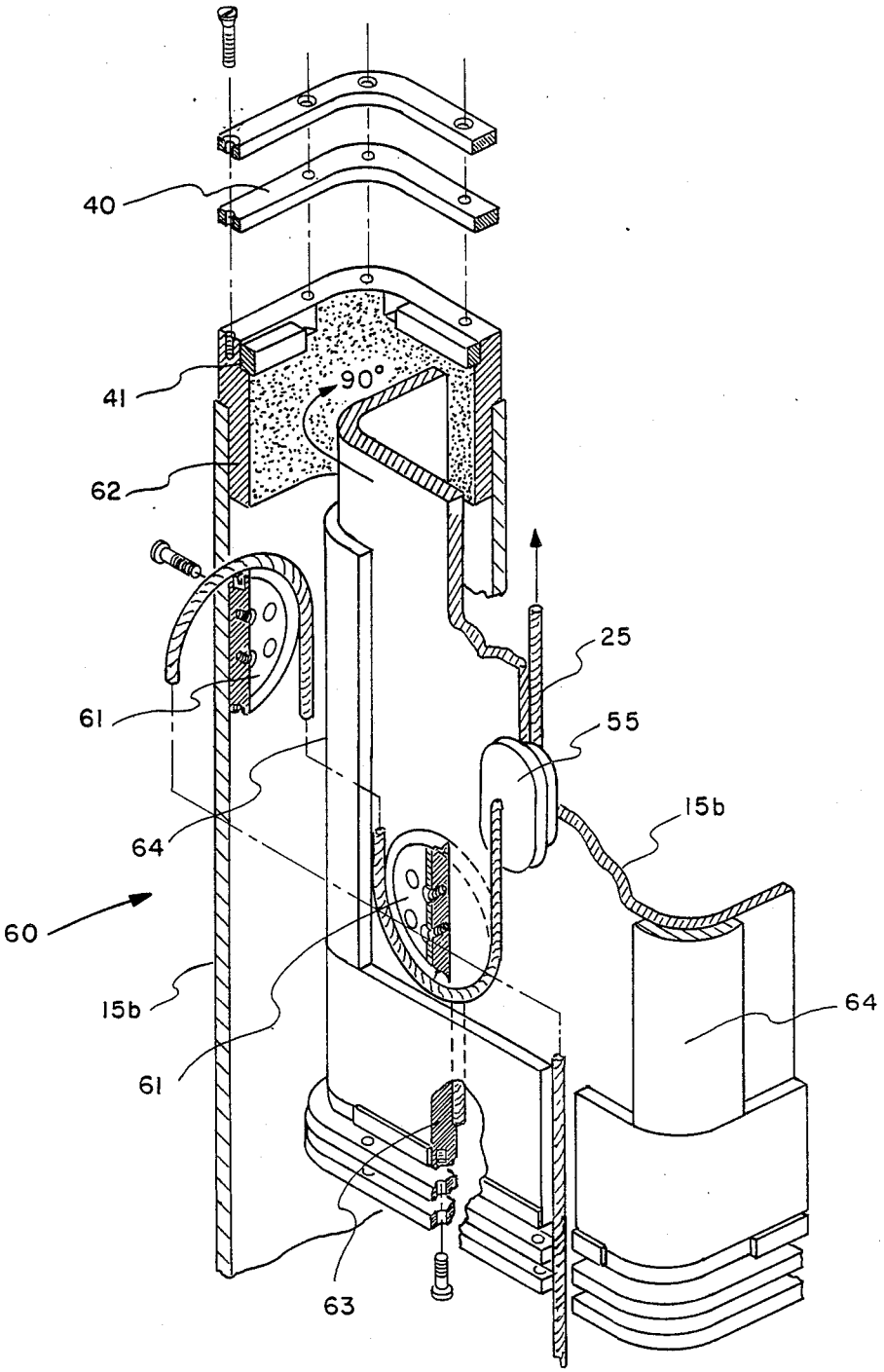
FIG. 20 is a cutaway exploded perspective view of a part of adjacent tubes in another embodiment of the invention in which the pulleys are mounted separately from the collars.

Although tubes 15 and 16 and base 17 may be formed of aluminum or other metal with the aforementioned disadvantages, they preferably are a composite carbon-fiber construction as described in related application Ser. No. 290,948. Also, while tubes 15 and 16 and support base 17 may have circular cross sections, they preferably have a polygonal-shaped cross section such as a square or modified square such as shown in FIG. 20. Mast tubes having the latter shapes are inherently keyed together to prevent relative rotation of the tubes and also inherently provide flat sides for mounting the lift/retraction pulleys.

Figure 5A:
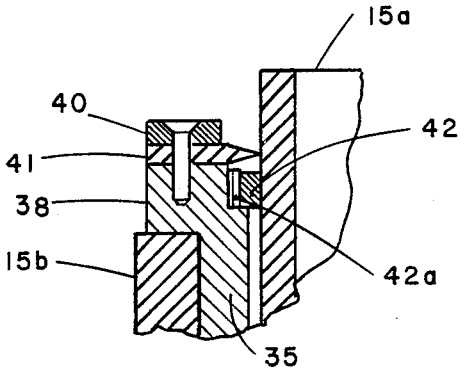
FIGS. 5*a*, 5*b*, and 5*c* are expanded sections of the top section of the mast tubes shown in FIGS. 5 and 6 showing details of the collars, seals and antifriction wear strips.
Figure 5:
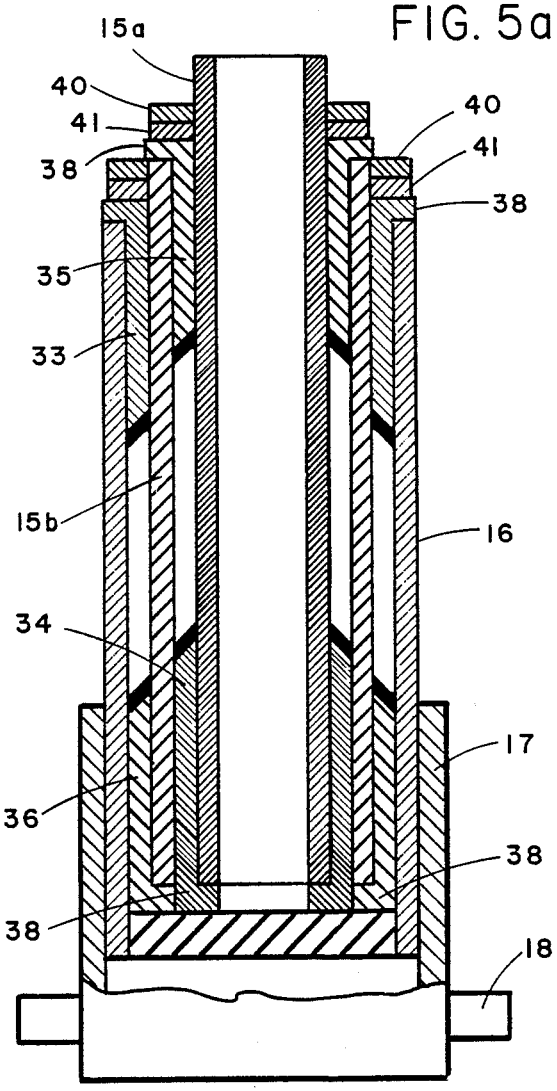
FIGS. 5 and 6 are vertical sections of the mast system showing the relative positions of the mast tubes in the retracted and extended positions, respectively, the ropes and pulleys having been omitted for the sake of clarity.
Figure 6:
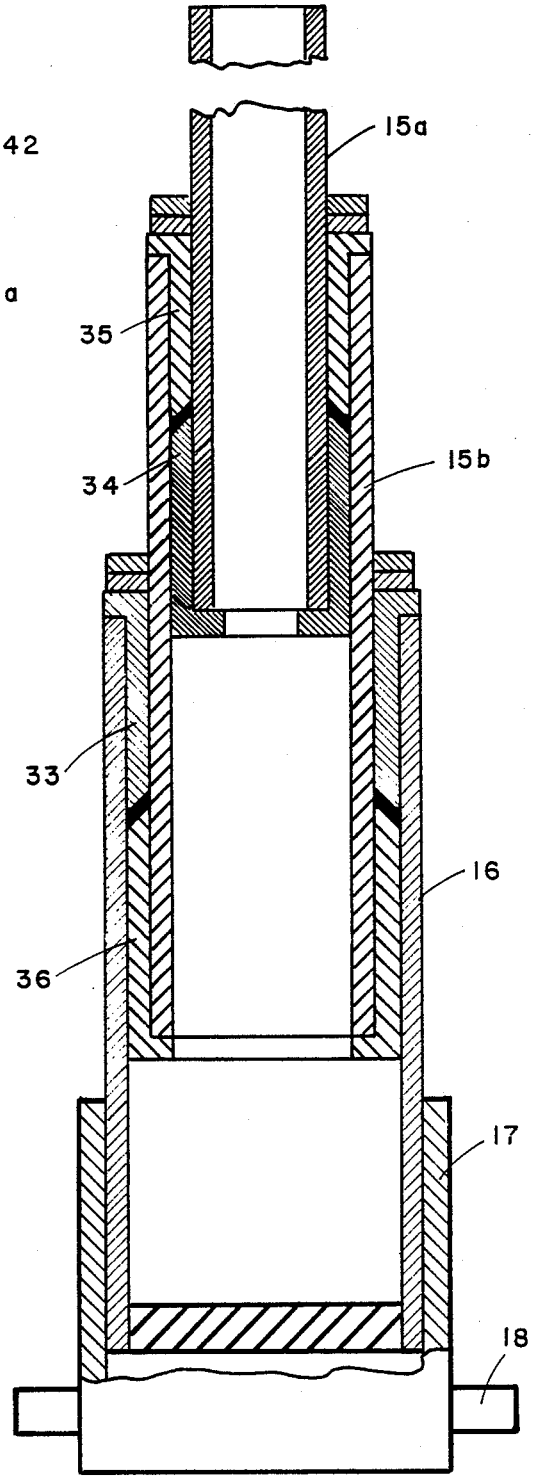
Figure 5A:
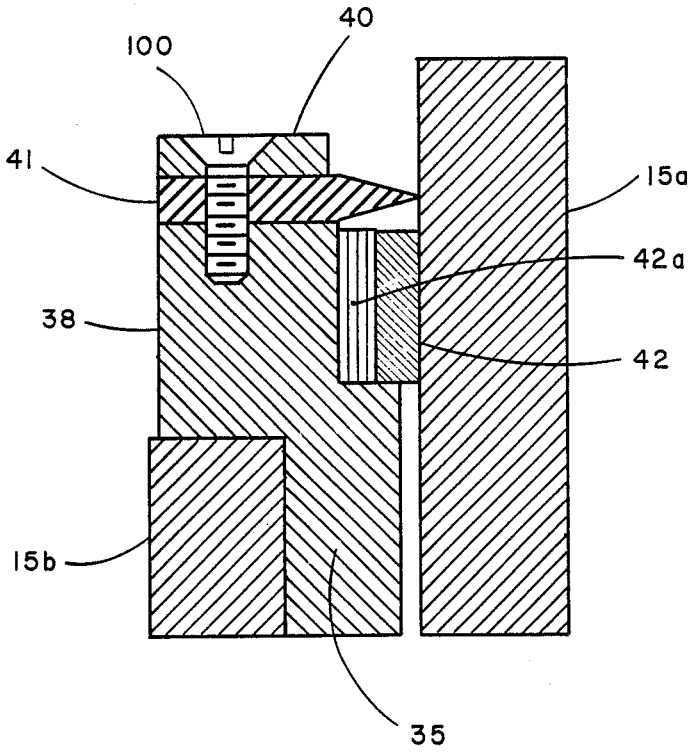
Figure 5B:
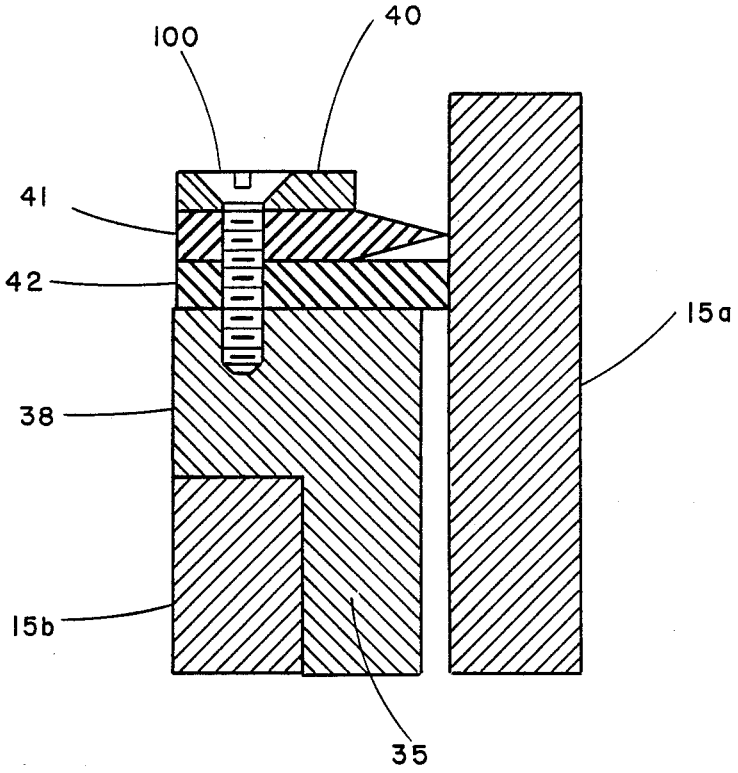
Figure 5C:
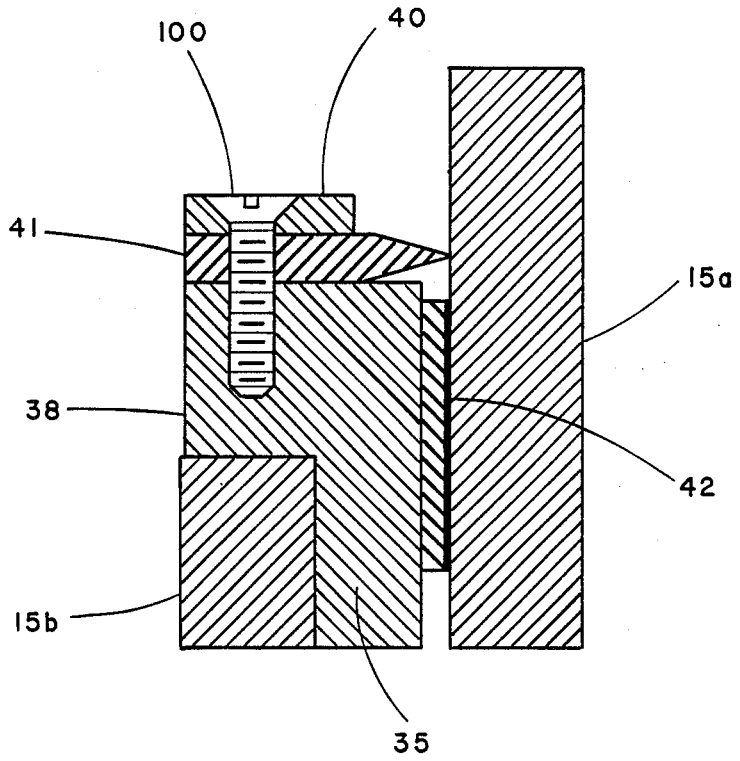
Figure 7:
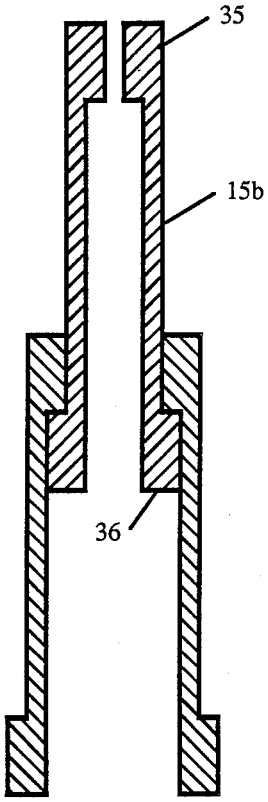
FIGS. 7, 8 and 9 are simplified schematic longitudinal sections of two of the mast tubes in the fully extended, partially extended and fully retracted positions, respectively.
Figure 8:
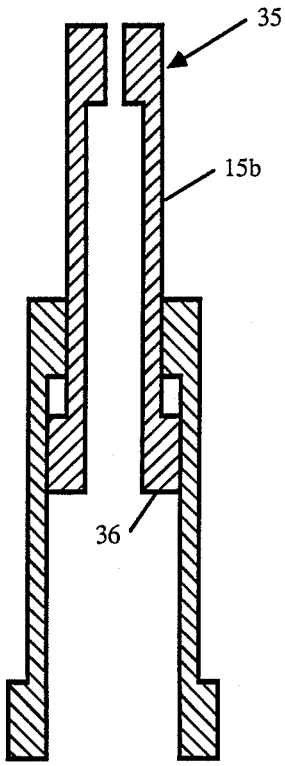
Figure 9:
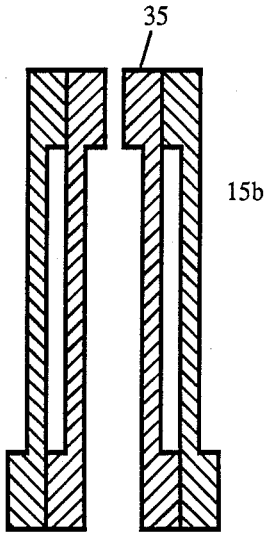
Figure 10:
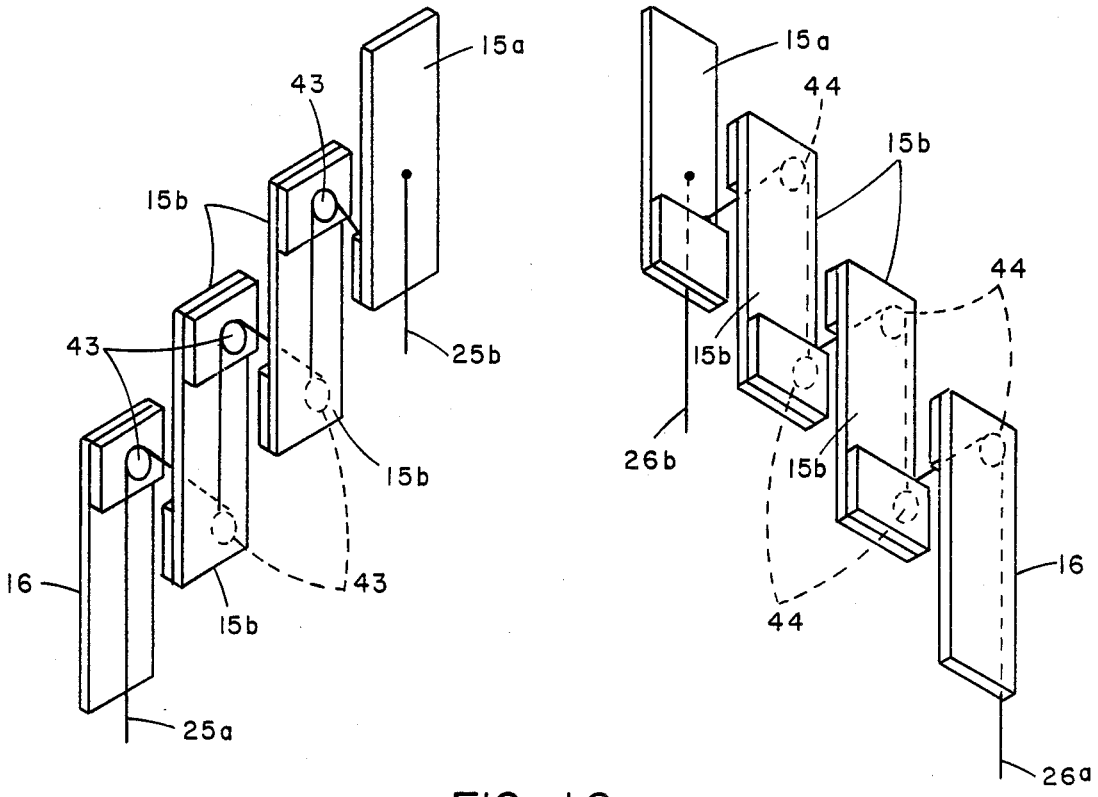
FIG. 10 is a simplified schematic perspective view of portions of the mast tubes with collars, the tubes being in the extended position showing opposite sides of each tube and the rope-pulley connections.
Figure 11:
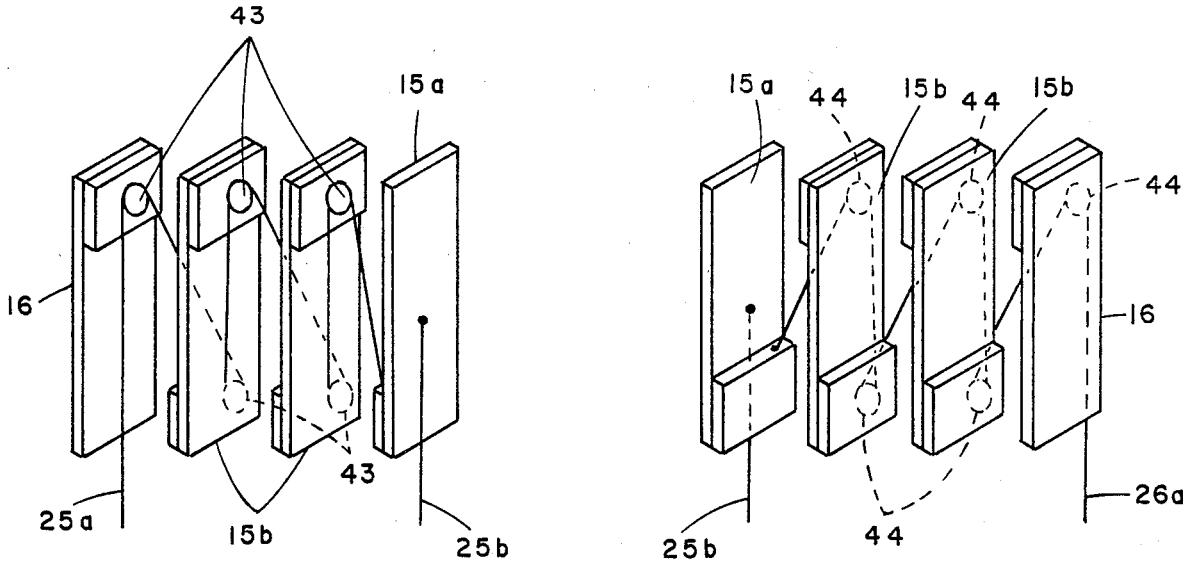
FIG. 11 is a view similar to FIG. 10 with the tubes in the stowed or fully nested position.

In one embodiment of the invention, axial (vertical) movement of tubes 15 relative to base tube 16 during erection of the mast system is limited by preferably annular collars 33–36 on tubes 16 and 15, see FIGS. 5–9. Base tube 16 has an upper internal collar 33, the innermost movable tube 15*a* has a lower external collar 34, and intermediate movable tube 15*b* has an upper internal collar 35 and a lower external collar 36. While each of these collars preferably is a unitary, annularly-shaped structure, the invention may also be practiced with a multipiece collar structure wherein the parts of each collar are located on opposite sides of each tube. Although only one intermediate tube 15*b* is shown in FIGS. 5 and 6, in practice the mast system has a plurality of such tubes, the number depending on the required height of the innermost tube 15*a* when the mast system is in the fully extended operative position. Referring to the detailed drawings in FIGS. 5*a*, 5*b*, and 5*c*, each collar has a radial lip 38 at one end which overlies and engages the proximate end of the associated tube to provide additional section modulus for increased stiffness. As shown in FIG. 5*a* annular seals 41, antifriction wear strips 42 and shims 42*a* are held in place by seal retainers 40 and are mounted on lips 38 of upper and lower collars 33 to 36 by screw 100 and engage the adjacent inner or outer tube to protect the internal parts of the mast system from the elements. The shims 42*a* are inserted between the collar 35 and the antifriction wear strip 42 as required to reduce play between the tubes. As shown in FIG. 5*b* both the seal 41 and the antifriction wear strip 42 are clamped in place by screw 100. As shown in FIGS. 5 and 6 antifriction wear strips 42 are bonded to the surface of collar 35 and engage the adjacent inner or outer tube to reduce friction and eliminate play between the relatively moving parts. The relative positions of the collars with interdiate tubes 15*b* in the fully extended, partially extended and stowed positions are illustrated schematically in FIGS. 7, B and 9, respectively. Alternatively, antifriction wear strips may be located adjacent to the annular seals to provide ease of replacement if desired. Alternatively, annular seals may be bonded with adhesive to delete the seal retainers and to reduce parts and cost. And, as a final alternative, annular collars may be replaced by segmented stops to reduce cost if operational side loads are low.

In order to extend and retract telescoping tubes 15 when the mast system is in the upright position, capstan-wound ropes 25 and 26 extend from base-mounted pulleys 28 and 29 and successively engage pulleys 43 and 44, respectively, see FIGS. 3, 4, 10 and 11, on opposite sides of base tube 16 and intermediates 15*b*. Only portions of the tubes are depicted schematically in FIGS. 10 and 11 and are laterally spaced apart for the sake of clarity of illustration. In addition to redundancy, the purpose of two sets of ropes and pulleys is to provide balanced extension and retraction forces for telescoping tubes 15 and to reduce the rope tension and component stresses particularly for heavy payloads. Since both sets are substantially the same, only one set is described hereinafter. (Alternatively, additional sets of ropes and pulleys may be used to provide increased lifting capability, if desired.)

Each pulley 43 consists of a sheave 45, see FIGS. 12, 13 and 14, peripherally grooved to receive rope 25 and mounted on a plurality of roller bearings 46 on the circular inner circumference of pulley body 47; the assembly is held intact by a retainer 4B which is held to pulley body 47 by screws. A substantially U-shaped recess or cavity 50, see FIG. 14, is formed in each of the collars 33, 34, 35 and 36 of base tube 16, intermediate tubes 15*b* and innermost tube 15*a*, respectively, and is sufficiently large to receive pulley 43 and to permit freedom of movement of rope 25 between adjacent pulleys while providing retention from slipping off inadvertently; in the drawings, one tube 15*b* with upper collar 35 and adjacent tube 15*b* with lower collar 36 are shown by way of example. One side of each recess 50 is closed by the wall of tube 15*b* to which the particular collar is secured, and the opposite side of the recess opens in a direction away from the closed side. Screws 51 fasten pulley body 47 and retainer 4B to the wall of the associated tube 15*b*. In accordance with a feature of this invention, pulleys 43 are thus totally enclosed within the mast system at all times and accordingly are never exposed to the elements during normal operation of the system. This is achieved because the open side of each collar recess 50 is covered by the wall of adjacent tube 15*b* at all times during operation of the mast system. Such construction of enclosed pulleys 43 insures a long trouble free life to these moving parts of the system. Additional protection of pulleys 43 and the rope 25 is provided by annular seals 41 described above in connection with FIGS. 5 and 6. An opening 52, see FIGS. 14, 15 and 16, and a vertical passageway 53 in collar 36, see FIG. 14, permits traverse of rope 25 between adjacent pulleys.

As rope 25 passes through tube wall opening 52 of one intermediate tube 15*b* to a pulley on the adjacent inner tube, the rope presses hard against the part of the tube wall defining the opening during mast extension and retraction. This can result in excessive wear as the rope moves relative to the tube which in time could unduly enlarge opening 52 and which, if allowed to progress unimpeded, could weaken tube 15*b* and rope 25. Such weakening would be due to an undesired increase in the length of the slot in the tube wall. The rope would be weakened by the rubbing action against the inherently abrasive material of which the tube is made. In order to accommodate this wearing action, opening 52 is formed at an upwardly (as viewed) inwardly inclined angle, see FIGS. 15 and 16, in a replaceable insert 55 which is secured in a larger opening 56 in the tube wall. This enables the selection of insert 55 made from a wear resistant material such as nylon and permits a replacement of the worn insert when required. Alternatively the replaceable insert may be a hollow tube pressed into a round hole which is machined into the tube wall to minimize the stress concentrations of the larger opening. Alternatively the replaceable insert may have a slot in it to allow replacement of the insert without having to remove the rope.

Figure 17:
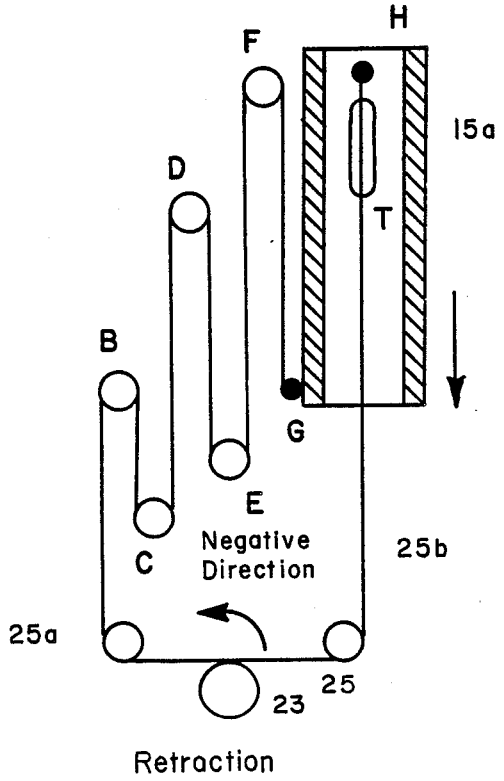
FIGS. 17 and 18 are schematic views of one of the two pulley-rope assemblies of the mast system illustrating the relative positions of the pulleys and directions of rope movement during retraction and extension, respectively, of the tubes.
Figure 18:
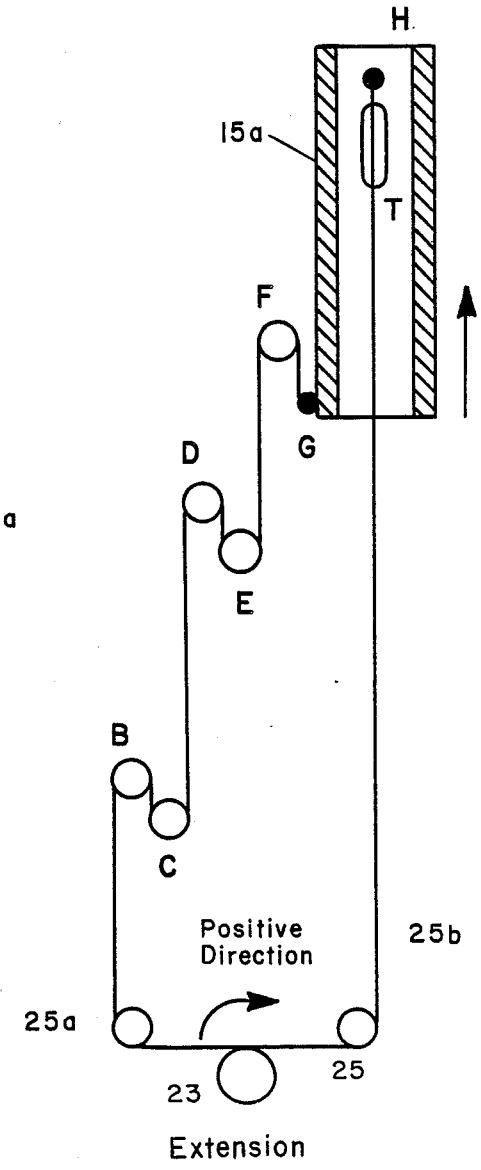

The operation of the pulleys and ropes in lowering and elevating the mast system is now described with reference to FIGS. 17 and 18 in which only one half of the dual pulley system is shown. In these two drawings, the pulleys are designated by letters B–F as are connections of the ends of the two lengths 25*a* and 25*b* of rope 25 to the innermost or top tube 15*a*, the intermediate tubes 15*b* and base tube 16 having been omitted for sake of clarity. As shown in FIG. 17, rotation of capstan 23 in one direction, counterclockwise as shown, causes rope 25*b* to apply a downward force on tube 15*a* at connection H. Preferably, rope 25 length is connected to tube 15*a* by a turnbuckle T to permit adjustable tensioning of the rope. The end of the other rope length 25*a*, connected to tube 15*a* at G, also (and necessarily) moves upwardly, as viewed in FIG. 17, as capstan 23 pays out rope in succession to pulleys B, C, D, E and F. Pulley B is designated as being in a fixed position and represents the pulley in the upper collar 33 of base tube 16 while pulleys C-D would be mounted on one intermediate tube 15*c* and pulleys E-F would be mounted on the adjacent intermediate tube 15*b*. Several turns of rope 25 loosely wound around capstan 23 develops sufficient friction to prevent slipping. Conversely, elevation of tubes 15*a* and 15*b* is accomplished by rotation of capstan 23 in the opposite or clockwise direction, see FIG. 18, which moves rope length 25*a* downwardly from fixed pulley B so as to cause successive elevation of pulleys C-D and E-F and to apply tension to the rope at connection G so as to elevate innermost tube 15*a*. As each intermediate tube is lifted to its height limit dictated by abutment of the collars thereon with that of the adjacent outer tube, the next inner tube is lifted until innermost tube 15*a* reaches its fully elevated position shown in FIG. 18. The order of tube extension is an issue controlled by the mechanics of the system and, the innermost tube may extend first, depending on the vagaries of friction, rope tension, number of tubes and payload weight.

Figure 19:
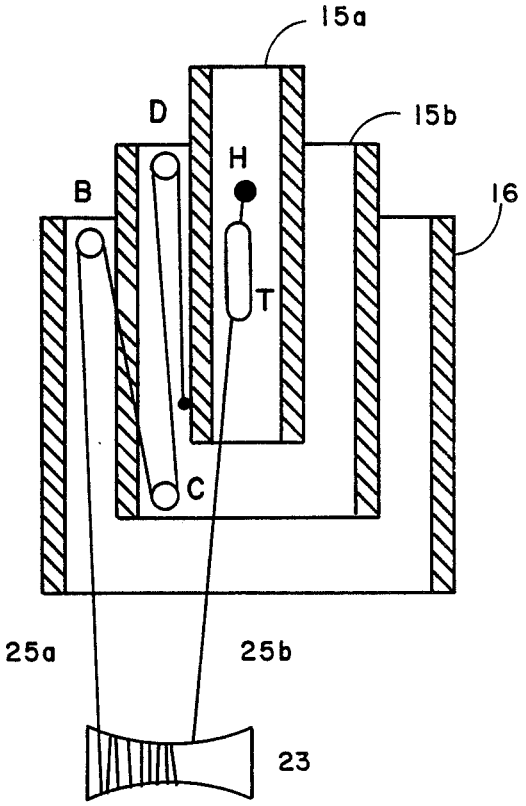
FIG. 19 is a schematic view similar to FIGS. 17 and 18 showing an alternative rope-pulley arrangement.

An alternative rope-pulley arrangement is depicted in FIG. 19 where a single capstan 23 and three pulleys B, C, and D are employed to retract and extend the three tube arrangement. The rope ends 25*a* extends around pulley B, on the base tube, and then on to pulleys C and D before making connection to the innermost tube 15*a* at connection G shown on the lower portion of the innermost tube. And the other rope end 25*b* extends upwardly to connection H on innermost tube 15*a* through the turnbuckle. In this arrangement rope 25 applies both extension and retracting forces to tube 15*a* when capstan 23 is rotated in opposite directions. The simplicity of this arrangement is obvious., only a minimum number of components is required.

A payload, not shown in the drawings, such as an antenna would be secured to the upper end of innermost tube 15*a* prior to elevation thereof to the fully extended position. A sufficient length of antenna feed cable, not shown, is provided within or without tubes 15*a*, 15*b* and 16 to allow full extension of the mast.

The use of capstans 23 and 24 in the mast system is unique and highly advantageous. The capstan occupies a minimum of space compared to a reel type winch which requires two reels—a payout reel and a takeup reel—to perform the function of one capstan. Moreover, the capstan automatically maintains optimum tension on both lengths of cable extending therefrom during and after extension and retraction of the mast sections. Fewer parts and cables are required for the capstan drive than with the reel drive. In addition, the relative tension between the "up" and "down" lengths of cable is automatically equalized with use of the capstan drive whereas separate reels require an additional mechanism—a one-way slip clutch.

Another embodiment of the invention is shown in FIG. 20 in which mast system 60 has pulleys 61 secured to the walls of an intermediate tube **15*b* and base tube 16 as described above, but at positions that are axially spaced from upper collars 35 and lower collars 36 on the respective tubes. In mast system 60, innermost, intermediate and base tubes have square cross-sectional shapes and the intermediate tube 15*b* illustrated is depicted in the drawing as being rotated by 90° from its actual relative position for clarity of illustration. Mechanical stops 64, two of which are shown in the drawing, are bonded one to each corner of and at the lower end of each intermediate tube 15*b*, each stop 64 being positioned to abut the lower edge of collar 35 on the adjacent base tube 16, the lengths of the stops being selected to provide the desired amount of overlap of tubes when fully extended. Stops 64 have sufficient thickness and/or are shimmed to insure contact with the inner surface of the adjacent outer tube and preferably are made of nylon or the like to facilitate antifriction engagement with that tube. In other respects, the mast system 60** is the same as that described above, like reference characters indicating like parts on the drawings.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings. For example, although the preferred embodiments have been described with reference to pulleys, such as B–F in FIG. 17, it would be possible to employ a grooved surface upon which the wire rope 25 could travel. Alternatively a simple metal pin or rod could be employed. Under such conditions one would have to consider various aspects of the system relative to the potential wear and frictional forces applied a the points of contact.

What is claimed is:

1. An extendible and retractable telescopic mast system comprising:

a base for supporting said mast system;

a plurality of elongated tubes having aligned longitudinal axes and successively decreasing transverse dimensions to permit each of said tubes to axially slide therebetween, said tubes comprising:

a base tube having the largest transverse dimension and being secured to said base, said base tube having an upper portion and a lower portion;

an innermost tube with the smallest transverse dimension having a lower portion; and at least one intermediate tube positioned between the innermost and base tubes and having an upper portion and a lower portion, said intermediate and innermost tubes being axially movble relative to said base tube and to each other;

means for so axially moving said innermost and intermediate tubes, comprising:

winch means in close proximity to said base tube and having a capstan with a rope wound thereon, said rope having two lengths extending from opposite ends, respectively of said capstan;

first pulley means mounted on the upper portion of said base tube;

second and third pulley means mounted on the lower and upper portions, respectively, of said intermediate tube;

one of said rope lengths extending from said capstan to and around, in succession, said first pulley means and said second and third pulley means of the respective intermediate tubes, the ends of both of said rope lengths being connected to said innermost tube;

said winch means having motor means for selectively rotating said capstan in opposite directions for extending and retracting said intermediate and innermost tubes.

2. The mast system according to claim 1 wherein said means for so axially moving said innermost and intermediate tubes further comprises:

fourth and fifth pulley means mounted at the lower portion of and within said base tube, said fourth pulley means being positioned beneath said first pulley means for directing said one length of said rope from said capstan to said first pulley means, and said fifth pulley means being positioned beneath said innermost tube for directing the other of said rope lengths from said capstan to the connection thereof to said innermost tube, both of said lengths of rope extending from said fourth and fifth pulley means to connection with said innermost tube and enclosed entirely within said base and intermediate tubes.

3. The mast system according to claim 2 in which the upper ends of said base and intermediate tubes have annular seals engaging the adjacent intermediate and innermost tubes, respectively.

4. The mast system according to claim 1 in which said base has internal collar means at the upper portion thereof, said intermediate tube having internal collar means at the upper portion thereof and external collar means at the lower portion thereof, the internal and external collar means of adjacent tubes abutting each other when said adjacent tubes are at their fully extended position, each of said collar means comprising an annular collar having at least one cavity therein, said pulley means comprising pulleys, one of said pulleys being mounted in each of said collar cavities with the axis of the pulley on one tube extending transversely of the direction of relative movement of the adjacent tube.

5. The mast system according to claim 4 in which each of said pulleys is mounted on the associated tube axially spaced closely to said collar means on said tube.

6. The mast system according to claim 1 further comprising means for rotating said tubes in a nested position from a vertical axis alignment to a horizontal axis alignment.

7. The mast system according to claim 6 in which said base further comprises a mobile vehicle having a platform for supporting said mast system.

8. The system according to claim 1 in which each of said base and intermediate tubes has a wall with an opening therethrough, an insert removably mounted in each of said wall openings, each of said inserts having an opening therein, said rope extending from the respective pulleys on said base tube and intermediate tubes successively inwardly therefrom through said insert openings to the proximate pulley on the adjacent tube.

9. The system according to claim 8 in which each of said inserts is formed from wear-resistant material.

10. The system according to claim 9 in which said inserts are formed from nylon.

11. An extendible and retractible telescopic mast system comprising:

a base;

a plurality of elongated nested tubes having substantially square cross-sections and aligned longitudinal axes and successively decreasing transverse dimensions, said tubes comprising a base tube having an upper end and side walls with the largest transverse dimension an innermost tube having side walls with the smallest transverse dimension, said innermost tube having a lower portion, and a plurality of intermediate tubes between the innermost and base tubes having side walls with successively decreasing transverse dimensions, each of said intermediate tubes having lower and upper ends, said base tube being permanently secured to said base, said intermediate and innermost tubes being axially movable relative to said base tube and to each other; and means for so axially moving said innermost and intermediate tubes, comprising:

winch means mounted in close proximity to said base tube and having at least two capstans, each of said capstans having a rope wound thereon, each rope having lengths thereof extending from opposite ends, respectively, of the associated capstan;

first and second pulleys mounted at the upper ends of opposite side walls of said base tube;

third and fourth pulleys mounted at the lower and upper ends, respectively, of one side wall of each of said intermediate tubes;

fifth and sixth pulleys mounted at the lower and upper ends, respectively, of the other side wall of each said intermediate tubes;

one length of one of said ropes extending from one of said capstans to and around, in succession, said first pulley and said third and fourth pulleys of the respective intermediate tubes for connection to said innermost tube;

one length of the other of said ropes extending from one end of the other of said capstans to and around, in succession, said second pulley and said fifth and sixth pulleys of the respective intermediate tubes for connection to said innermost tube;

the other lengths of said ropes, respectively, extending from the other ends, respectively, of said capstans for direct connections to said innermost tube;

said winch means having motor means for selectively rotating said capstans as a pair in opposite directions for extending and retracting, respectively, said intermediate and innermost tubes.

12. The mast system according to claim 11 in which the upper ends of said base and intermediate tubes have annular seals engaging the adjacent intermediate and innermost tubes, respectively.

13. The mast system according to claim 11 in which said base has internal collar means at the upper portion thereof, each of said intermediate tubes having internal collar means at the upper portion thereof and external collar means at the lower portion thereof, the internal and external collar means of adjacent tubes abutting each other when said adjacent tubes are at their fully extended position, each of said collar means comprising an annular collar having a pair of cavities therein, one of said pulleys being mounted in each of said cavities with the axis of the pulley on one tube extending transversely of the direction of relative movement of the adjacent tube.

* * * * *